United States Patent [19]

Murakami et al.

[11] 4,200,796

[45] Apr. 29, 1980

[54] STORAGE CELL TYPE X-RAY APPARATUS

[75] Inventors: Fumio Murakami, Funabashi; Takeshi Enya, Nara; Yoshinori Ochiai, Kashiwa, all of Japan

[73] Assignee: Hitachi Medical Corporation, Tokyo, Japan

[21] Appl. No.: 915,773

[22] Filed: Jun. 15, 1978

[30] Foreign Application Priority Data

| | | | |
|---|---|---|---|
| Jun. 17, 1977 | [JP] | Japan | 52-71009 |
| Jun. 17, 1977 | [JP] | Japan | 52-71012 |
| Sep. 9, 1977 | [JP] | Japan | 52-107916 |

[51] Int. Cl.[2] ..... H05G 1/30

[52] U.S. Cl. ..... 250/402; 250/409; 250/421

[58] Field of Search ..... 250/401, 402, 408, 409, 250/421

[56] References Cited

U.S. PATENT DOCUMENTS

| | | | |
|---|---|---|---|
| 3,125,679 | 3/1964 | Ohde | 250/402 |
| 3,320,477 | 5/1967 | Boeker | 250/421 |
| 3,564,243 | 2/1971 | Takao | 250/402 |
| 3,828,194 | 8/1974 | Grasser | 250/402 |

*Primary Examiner*—Craig E. Church

*Attorney, Agent, or Firm*—Wenderoth, Lind & Ponack

[57] ABSTRACT

A storage cell type X-ray apparatus uses a storage cell as its power source and operates so that the dc voltage of the power source is converted to an ac voltage, this ac voltage is elevated to a higher voltage and rectified to obtain a high dc voltage. The resulting voltage is applied to an X-ray tube, to cause this X-ray tube to emit X-rays. This apparatus includes means for stabilizing the voltage applied to the X-ray tube.

11 Claims, 17 Drawing Figures

40
41
42
43
45
80
80a
80b
81
82
83
84
85
86
87
88
91
92
93
95
96
97a
97b
98a
98b
99a
99b
100a
100b
101
102
103
104
105
106
107
J
CP
K
Q
Q̄
a
b
c
d
e
f
g
h
i
j
+
-

STORAGE CELL TYPE X-RAY APPARATUS

BACKGROUND OF THE INVENTION

The majority of X-ray apparatuses currently used in hospital wards for diagnosis of non-transferable hospitalized patients are capacitor-type X-ray apparatuses. This type known X-ray apparatus, however, has problems because an electric cord for the connection of the X-ray apparatus to a power source has to be connected to the terminals of an ac power source such as the plugs provided in each patient room for each use, and, owing to the small amount of X-rays produced, it is not possible to take X-ray pictures of a thick object such as the lumbar, thus limiting the regions which can be examined. Such an X-ray apparatus used for visiting rounds in a hospital must solve these problems, and at the same time it must satisfy the following essential requirements of an X-ray apparatus intended for visiting rounds in a hospital: (1) the X-ray emission operation must be simple and the functions of the control circuit must be stable and (2) the apparatus must be light in weight to facilitate the visiting rounds to the patients' rooms in the hospital wards. In order to satisfy these conditions and requirements, there is a method comprising converting the dc voltage from a storage cell included in the apparatus to an ac voltage and raising this voltage to the higher voltage required for the emission of X-rays. However, the control circuit for converting the dc voltage to an ac voltage has to be simple in structure and well stabilized to achieve the foregoing purposes.

In general, the voltage across the terminals of a storage cell will drop progressively as this storage cell is progressively discharged. That is, as compared with the terminal voltage when the storage cell is fully charged, the terminal voltage of the storage cell when this cell must be re-charged will have a value reduced by about 20 to 30%. The amount of X-rays produced varies in proportion to 2 to 5 times the square of the X-ray tube voltage. From this point of view it is known that, in a transformer type X-ray apparatus the range of permissible difference in the X-ray tube voltage is considered to be ±7%. This limitation is much more severe than the permissible difference for the X-ray tube current or for the time of photography. Accordingly, when a storage cell is used as the power source for an X-ray apparatus, it is necessary to effect compensation, by some means or other, this drop in the terminal voltage of the storage cell and to minimize the variation in the utilizable amount of X-rays caused by the changes in the X-ray tube voltage. Furthermore, as the discharge of the storage cell progresses and as its terminal voltage reaches a level at which re-charging of the storage cell is inevitable, it is necessary to stop further discharge for protection of the storage cell. In known storage cell type X-ray apparatuses, there is adopted a method of manually regulating the positions of the slidable contacts of a transformer employed for regulation of the voltage in order to compensate for the drop in the X-ray tube voltage caused by the voltage drop of the storage cell. This manual operation method, however, requires constant monitoring of the voltage level of the storage cell, so that the burden imposed on the operator is heavy, and what is more, there is the fear that, if this manual operation is neglected, the storage cell will be excessively discharged so that the life of this storage cell could be shortened. If, as a countermeasure, a storage cell having a very large capacity is used, this will inevitably lead to an increase in the weight and the size of the storage cell, and accordingly the price of the apparatus as a whole would be higher.

In a storage cell type X-ray apparatus, a rectangular wave voltage is generally used. This rectangular wave voltage is such that the built-up of voltage at the time of turning-on is quick, and accordingly, an abnormally high voltage may be developed due to transitional phenomenon. Thus there is the danger that the X-ray tube may be broken and/or that a dielectric breakdown may occur. In the conventional X-ray apparatus using the commercial power source, the connection of the apparatus to the power source occurs at zero phase in order to prevent the generation of an abnormally high voltage at the time of starting the X-ray emission. However, in an X-ray apparatus of the dc-ac conversion type such as described above, it should be understood that the formation of an input waveshape such as a sine wave having a slow built-up in order to achieve connection of the X-ray apparatus to the power source at zero phase involves the problem that the circuitry required tends to become too complicated and too large in size when consideration is given to the fact that the power source device of the X-ray apparatus is designed to use momentary on-off pulses having large current. However, in an X-ray apparatus of the type in which the high voltage power supply device and the X-ray tube device are used in the vicinity of their rated voltage, it is mandatory that any abnormally high voltage at the time of the start of emission X-ray (at the time that an electric voltage is connected to the apparatus) be unfailingly controlled from view point of protection of the apparatus and safety.

SUMMARY OF THE INVENTION

It is, therefore, a primary object of the present invention to provide a storage cell type X-ray apparatus which is simple in structure and which is stable in operation.

Another object of the present invention is to provide a storage cell type X-ray apparatus of the type described above, which minimizes the effect of a drop of the terminal voltage of the storage cell used as the power source for the X-ray emission and which protects the storage cell from excessive discharge.

Still another object of the present invention is to provide a storage cell type X-ray apparatus of the type described above, which unfailingly supresses the generation of any abnormally high voltage at the time of the start of the X-ray emission.

A further object of the present invention is to provide a storage cell type X-ray apparatus of the type described above, which minimizes the effect of the drop in voltage of the storage cell upon the control circuit controlling the voltage of the X-ray tube.

A further object of the present invention is to provide a storage cell type X-ray apparatus of the type described above, which has a control means which prevents the application of an abnormally high voltage to the X-ray tube even when the filament of this X-ray tube is broken.

These and other objects as well as the features and the advantages of the present invention will become apparent from the following detailed description of the preferred embodiments when taken in conjunction with the accordingly drawings.

DETAILED DESCRIPTION OF THE PREFERRED EMBODIMENTS

Figure 1:
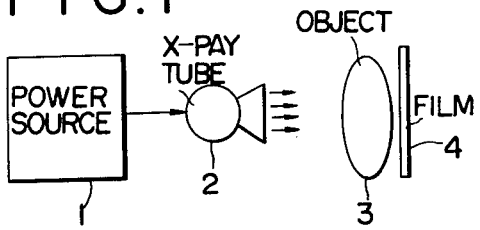
FIG. 1 is a block diagram showing an example of the X-ray apparatus to which the present invention is applied.

In the X-ray apparatus shown in FIG. 1, reference numeral 1 represents a power source device using a storage cell as the power source for generating a high dc voltage. Numeral 2 represents an X-ray tube for emitting X-rays by the application of the high dc high voltage thereto. Numeral 3 represents an object to be photographed which is a part of a human body. Numeral 4 represents an X-ray film which is housed in a photography device for producing an image thereon as this film is exposed to the X-rays passing through the object.

Figure 2:
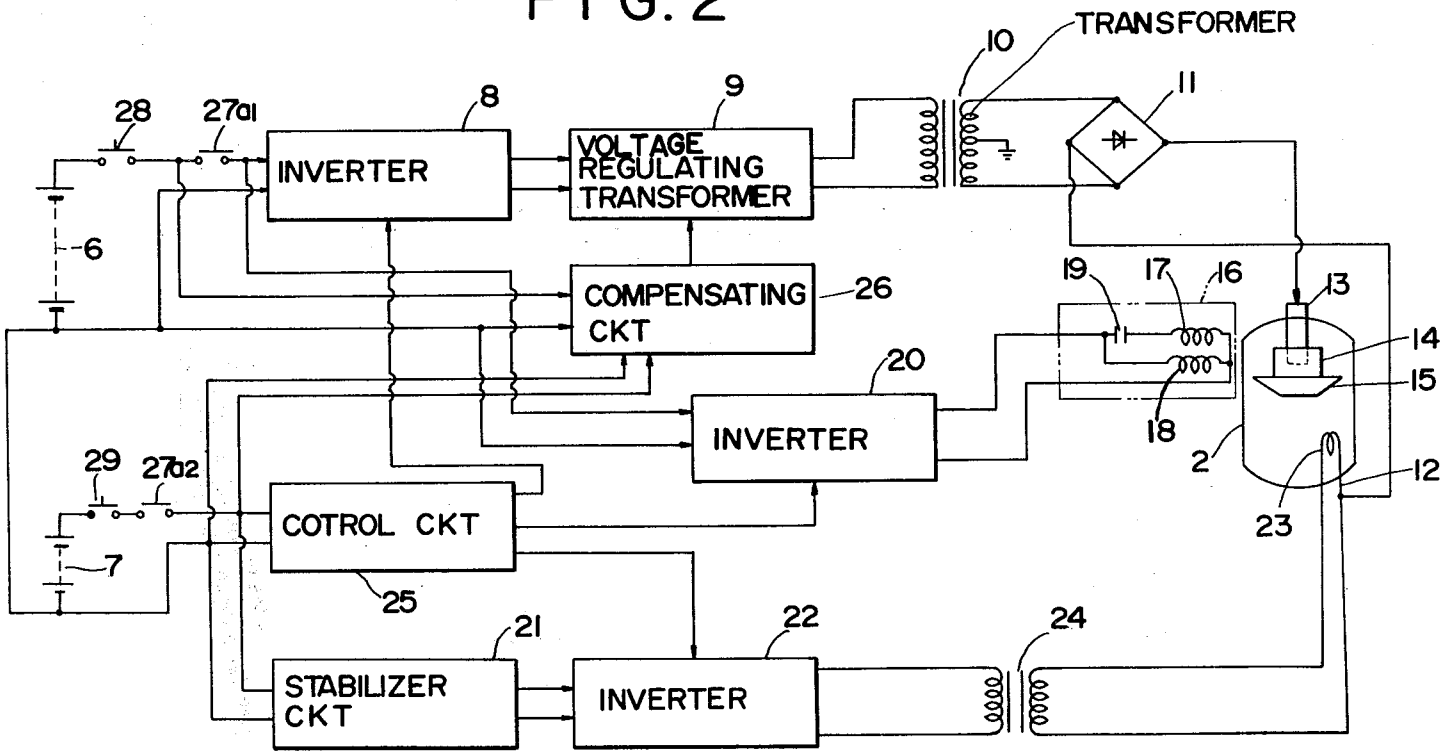
FIG. 2 is a block diagram showing an example of the apparatus of the present invention.

FIG. 2 shows a diagram of the arrangement of the X-ray apparatus according to the present invention. Numeral 6 represents a main power source storage cell having a relatively large capacity. Numeral 7 represents an auxiliary power source storage cell having a relatively small capacity. For example, a nickel cadmium storage cell of 150 V may be employed as the main power source storage cell 6. For example, a nickel cadmium battery of 26 V may be employed as the auxiliary power source storage cell 7. Numeral 8 represents an inverter for converting the direct current power from the main power source storage cell 6 into alternating current power. Numeral 9 represents a transformer for regulating the output voltage to obtain a regulated voltage from the output voltage of the inverter 8. Numeral 10 represents a transformer for raising the output voltage of the transformer 9. Numeral 11 represents a rectifier circuit for rectifying the output of the transformer 10. The rectified output is applied across the cathode 12 and the anode 13 of the X-ray tube 2. Numeral 14 represents a rotor rotatably mounted on the anode 13. Numeral 15 represents a target fixed to this rotor. Numeral 16 represents a field winding device provided around the X-ray tube 2. A capacitor 19 is connected to one of two windings 17 and 18 which are connected together in parallel. When an ac voltage is applied to the field winding device 16, currents of different phases flow through these windings 17 and 18 thereby generating a revolving field therein and rotating the rotor 14 and the target 15.

Numeral 20 represents an inverter for converting the dc from the storage cell 6 to ac and applying this ac to the field winding device 16.

Numeral 21 represents a stabilizer circuit for regulating the output voltage of the storage cell 7 in a certain relationship with output voltage of the transformer 9. Numeral 22 represents an inverter for converting the output of the stabilizer circuit 21 to an ac voltage for heating the filament 23 of the X-ray tube 2. Numeral 24 represents a transformer for blocking the a high voltage dc applied from the rectifier circuit 11.

Numeral 25 represents a control circuit for controlling the inverters 8, 20 and 22.

Numeral 26 represents a compensator circuit for monitoring the voltage of the storage cell 6, and for changing the connection terminals of the primary winding of the transformer 9 over to the terminals of a winding having a smaller number of turns so as to prevent a drop in the output voltage of this transformer 9 when the voltage of the storage cell has dropped to a level lower than a predetermined level.

Numerals $27a_1$ and $27a_2$ represent relay contacts which are energized by the closing action of a ready switch (not shown) which is closed when the X-ray apparatus is put to use. Numerals 28 and 29 represent manual switches which are turned on when the X-ray apparatus is put to use.

Figure 3:
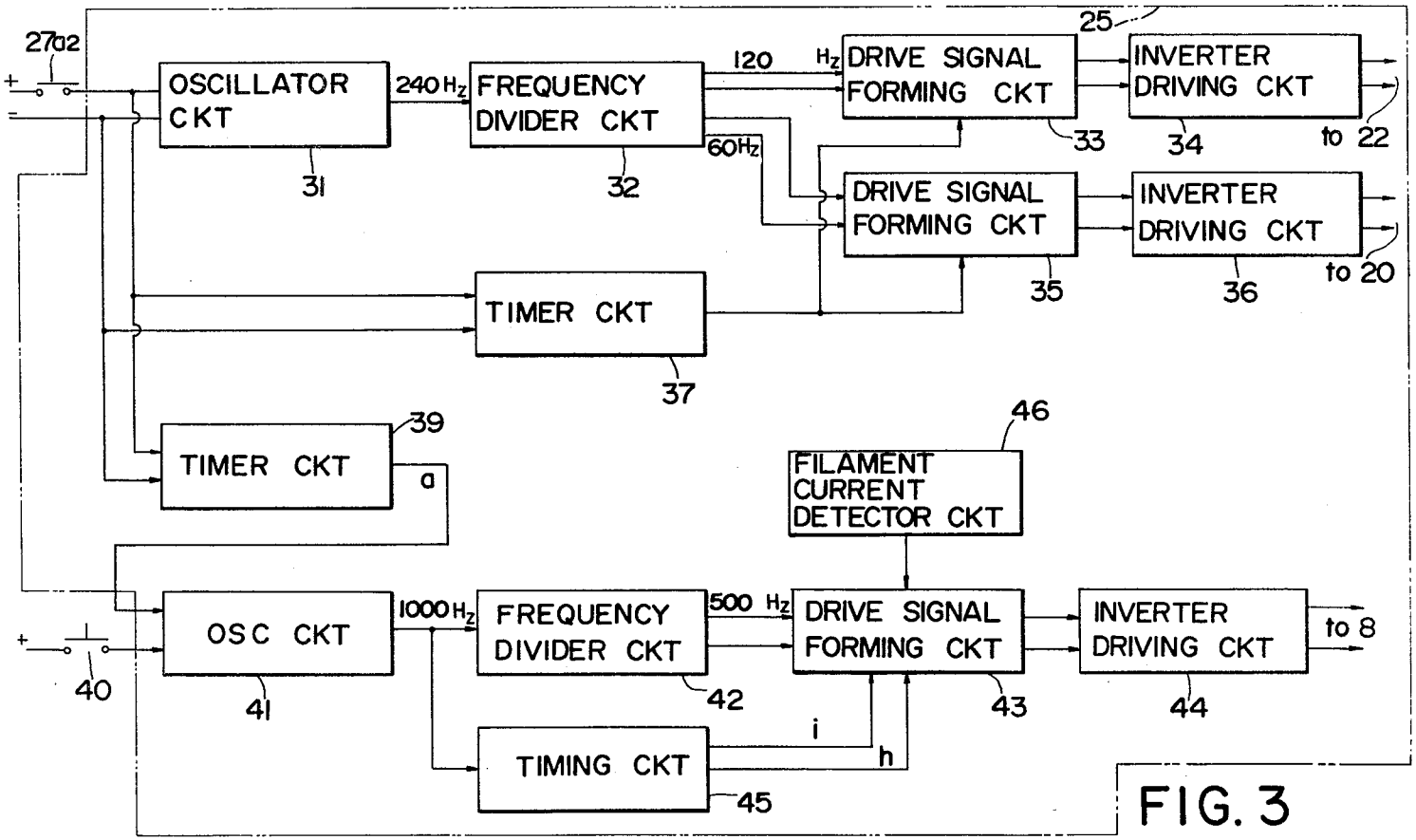
FIG. 3 is a block diagram showing in detail an example of the control circuitry of FIG. 2.

FIG. 3 shows the arrangement of the control circuitry 25 shown in FIG. 2. In FIG. 3, reference numeral $27a_2$ represents a relay contact which is energized by the closing action of a ready switch (not shown) which is closed when the X-ray apparatus is put to use. Numeral 31 represents an oscillator circuit for generating an ac signal in the form of rectangular wave pulses at 240 Hz which serves as the source of the control signal for heating the filament and for rotating the target. Numeral 32 represents a frequency divider circuit for dividing the frequency of the output of the oscillator circuit 31 to derive cyclic pulses at a pulse rate of 120 Hz for heating the filament and pulses having duty factor of 50% of 60Hz for rotating the target. Numeral 33 represents a drive signal forming circuit and numeral 34 represents an inverter driving circuit for driving the inverter 22 employed for heating the filament. Also, numeral 35 represents a drive signal forming circuit and numeral 36 represents an inverter drive circuit for driving the inverter 20 employed for rotating the target. Numeral 37 represents means for rendering the drive signal forming circuits 33 and 35 inoperative for the initial 0.05 second after the oscillator circuit 31 is started by the closure of the contact $27a_2$.

Numeral 40 represents an exposure switch which is closed at the time of X-ray emission. Numeral 41 represents an oscillator circuit for generating an ac signal in the form of rectangular wave pulses at 1000 Hz which serves as the source of the control signal of the inverter 8 provided in the main power source circuit for X-ray emission. Numeral 39 represents a timer circuit for delaying the start of the oscillator circuit 41 for 1.8 seconds after the closure of the contact $27a_2$ during which time the heated filament 23 and the rotating target 15 reach usable states. This oscillator circuit 41 is actuated only when there is an output from the timer circuit 39 and when the contact 40 is in its closed state.

Numeral 42 represents a frequency divider circuit for generating two alternative pulse cyclic trains having a duty factor of 50% at a frequency of 500 Hz from the cyclic pulse output of the oscillator circuit 41. Numeral 43 represents a drive signal forming circuit and numeral 44 represents an inverter driving circuit which are provided for the purpose of driving the inverter 8. Numeral 45 represents a circuit for delaying the start of the initial drive signal. Numeral 46 represents a filament current detector circuit for rendering the drive signal forming circuit 43 inoperative when no filament current present or when there is a uni-directional current is present.

Figure 4:
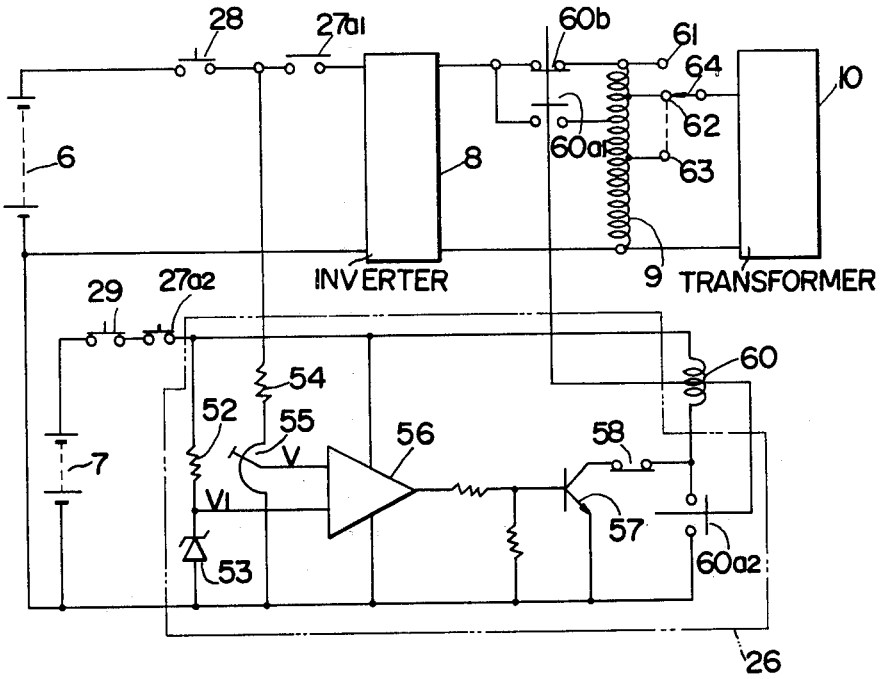
FIG. 4 is a circuit diagram showing an example of a compensating circuit according to the present invention for compensating for the voltage drop of the storage cell.

Next, explanation will be made of concrete examples of the respective circuits shown in FIGS. 2 and 3. FIG. 4 is a circuit diagram showing a concrete example of the compensator circuit 26. In FIG. 4, like parts are indicated by the same reference numerals employed in FIG. 2.

On the secondary side of the transformer 9 employed for voltage regulation, there is provided a manual rotary switch for changing the number of turns of the secondary winding. This switch comprises fixed contacts 61, 62, 63 and a movable contact 64. A normally closed contact **60*b* and a normally open contact 60*a* of a relay 60 are provided on the primary side for changing the number of turns of the primary winding. A resistor 52 and a Zener diode 53 provide a constant reference voltage. A resistor 54 and a variable resistor 55 provide a divided value of the output voltage of the storage cell 6. Numeral 56 represents a comparator circuit for comparing the reference voltage $V_1$ and a voltage V obtained from the output terminal of the variable resistor 55, and producing a high level output when $V_1 > V$. Numeral 57 represents a switching transistor which is rendered conductive by the high level output of this comparator circuit 56. Numeral 60 represents a relay having contacts $60a_1$ and 60*b* for changing the number of turns of the primary winding of the transformer 9 and having a self-holding contact $60a_2$. Numeral 58 represents a contact inserted between the relay 60 and the transistor 57** and which is opened during X-ray emission.

Figure 5:
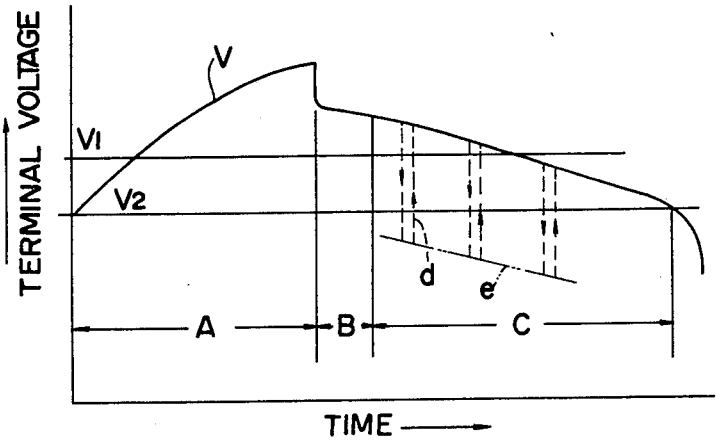
FIG. 5 is a charge-discharge curve plot of the storage cell for explaining the operation of the circuitry of FIG. 4.

FIG. 5 represents the behavior of the voltage V across the terminals of the storage cell 6 shown in FIG. 4. The horizontal axis represents time, and the vertical axis represents the voltage across the terminals. A represents the charge period, B represents the period of discharge without a load, and C represents the period of discharge with a load. The broken line d in the section C indicates the drop of the terminal voltage when a large momentary current is caused to flow during X-ray emission. Also, the voltage $V_1$ represents the reference voltage below which a change over of the number of turns of the primary winding of the transformer 9 is required, and $V_2$ represents the minimum voltage below which the discharge of the storage cell is stopped.

As will also be understood from FIG. 5, with such a load like an X-ray apparatus, the voltage of the storage cell which was above the reference voltage to be detected before the application of this load may drop to a level lower than this reference voltage to be detected as a result of the application of the load. This fact implies the necessity for holding the voltage state immediately prior to the X-ray emission throughout the X-ray emission period.

Next, the operation of the circuitry shown in FIG. 4 will be described.

The terminal voltage of the storage cell 6 prior to the X-ray emission is compared, by the comparator circuit 56, with the reference voltage which is generated by the resistor 52 and the Zener diode 53 through the resistors 54 and 55. Now, in case the terminal voltage V is lower than the reference voltage $V_1$ of FIG. 5, the transistor 57 is rendered "on" by the output of the comparator circuit 56, and the relay 60 is energized, so that the contact **60*b* is opened, whereas the contacts $60a_1$ and $60a_2$ are closed. As a result of these actions, the number of turns of the primary winding of the auto transformer 9** becomes reduced, so that the output voltage at the secondary output tap will be compensated when the terminal voltage of the storage cell drops.

Also, the contact 58 is kept open throughout the X-ray emission. However, in case the terminal voltage V is lower than the reference voltage $V_1$ as stated above, it will be understood that, because the relay 60 is actuated immediately before X-ray emission, the action of this relay is self-held by the contact $60a_2$ even when the contact 58 is opened. Also, in case the terminal voltage V is higher than the reference voltage $V_1$, the relay 60 is not actuated. Furthermore, in case the terminal voltage drops as shown by the dotted line d in FIG. 5 during the X-ray emission, it should be noted that, since the contact 58 is open during the X-ray emission, the relay 60 is not actuated.

The input voltage applied to the autotrians former 9 during the X-ray emission will become like that shown by two-dots-chain line e in FIG. 5. However, the voltage at such an instance will be substantially proportional to the terminal voltage shown by the solid line when there is no loading if the load current is constant. From this fact, measuring the terminal voltage during a time of no loading may be effective to prepare for compensation of the X-ray tube voltage resulting from a drop of the terminal voltage.

Figure 6:
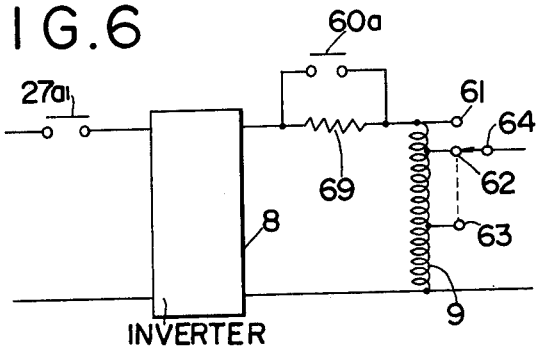
FIG. 6 is a circuit diagram showing another example of a compensating circuit according to the present invention for compensating for the voltage drop of the storage cell.

FIG. 6 is a circuit diagram showing another example of the present invention. Numeral 8 represents the inverter circuit of the main power source circuit. Numeral 9 represents an autotransformer for voltage regulation. In this example, instead of changing over the number of turns of the primary winding of the autotransformer 9, a resistor 69 is connected to the primary side of the autotransformer 9 for causing an appropriate voltage drop when the terminal voltage is higher than the reference voltage $V_1$. A drop in the X-ray tube voltage caused by a drop of the termainal voltage of the storage cell is compensated by short circuiting the opposite terminals of the resistor 69 by the contact 60*a* of the relay when the detected voltage of the storage cell becomes lower than the reference voltage. It should be understood here that this contact 60*a* is actuated in accordance with a control similar to that shown in FIG. 4 and previously described. Also, in both FIG. 4 and FIG. 6, a finer compensation for the X-ray tube voltage will become possible if a plurality of compensator circuits 26 are provided each comprised, of elements 52 to 58, 60 and 60*a*$_2$ so as to effect a multi-step changeover of the number of turns of the primary winding of the transformer 9 or a multi-step current control using a plurality of resistors 69.

Figure 7:
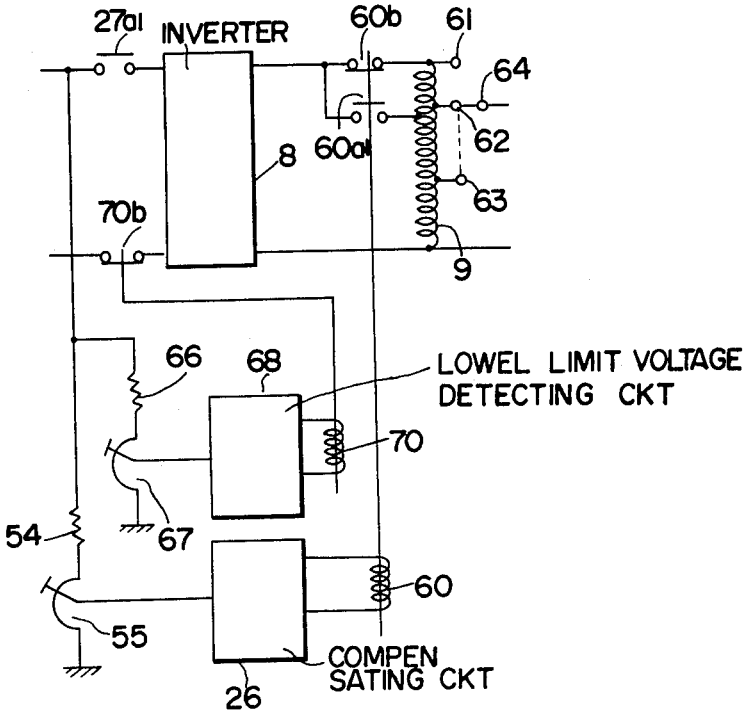
FIG. 7 is a circuit diagram showing an example of a circuit for detecting the lower limit voltage of the storage cell and for inhibiting the emission of X-rays.

Furthermore, FIG. 7 shows a circuit utilizing the principle stated above, for stopping X-ray emission when the terminal voltage of the storage cell falls below the reference lower limit voltage $V_2$ shown in FIG. 5. It should be understood that the parts indicated by the same reference numerals as those employed in FIG. 4 have the same functions, and also that those parts having no direct relationship to the explanation below are omitted.

As shown in FIG. 7, a resistor 66 and a variable resistor 67 divide the voltage of the storage cell to obtain a voltage for comparison with the lower limit reference voltage $V_2$. Relay 70 is actuated by a circuit 68 employed for detecting the lower limit voltage of the storage cell which is similar in arrangement to that employed in the compensator circuit shown in FIG. 4. Thus normally closed contact 70*b* of relay 70 which is inserted between the storage cell 6 and the inverter 8 is opened thereby stopping the X-ray emission when the storage cell voltage falls below the reference voltage $V_2$. It should be understood that this relay contact 70*b* may be inserted between the inverter circuit 8 and the transformer 9, or between the transformer 9 and the transformer 10.

In the circuits of FIG. 4 and FIG. 6 described above, an arrangement is provided for detection of the terminal voltage of the storage cell immediately prior to the X-ray emission In case the detected value is lower than a predetermined value, the tap for regulating the voltage is changed over so as to preserve the power supply voltage at its pre-emission level, thereby obtaining an X-ray photograph having uniform optical density at the time of taking the X-ray photograph. In addition, in the circuit of FIG. 7, an arrangement is provided for stopping the X-ray emission case the terminal voltage of the storage cell drops further emission. Therefore, this example has the advantage that damage to the storage cell due to excessive discharge can be prevented, and accordingly this example is optimum as an X-ray apparatus of the type using a storage cell as the power source.

Figure 8:
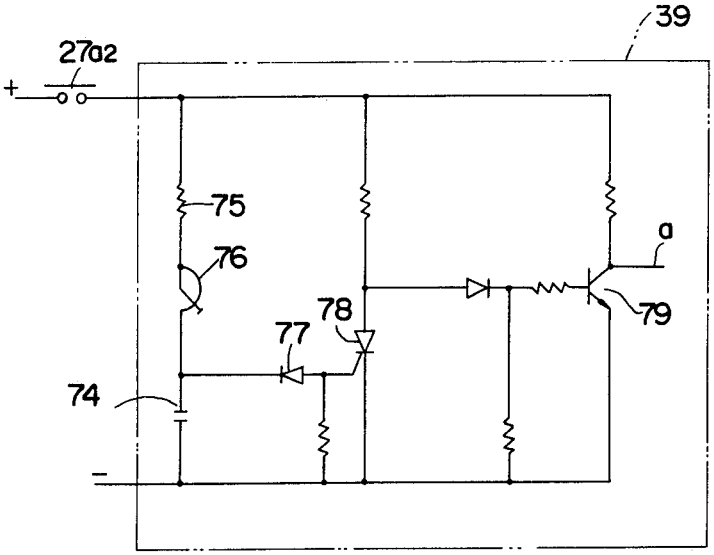
FIG. 8 is a circuit diagram showing an example of the timer circuit shown in FIG. 3.

As shown in FIG. 8, the timer circuit 39 shown in FIG. 3 is a circuit which charges the capacitor 74 by the current flowing through a resistor 75 and a variable resistor 76 when the contact 27*a*$_2$ is closed. When, after the lapse of time of about 1.8 seconds, the voltage of the capacitor 74 surpasses 6V which is the Zener voltage of the Zener diode 77, a gate current flows through a thyristor 78 rendering this thyristor 78 conductive, whereby the base current of transistor 79 ceases to flow, thereby rendering the output a into a high level.

Figure 9:
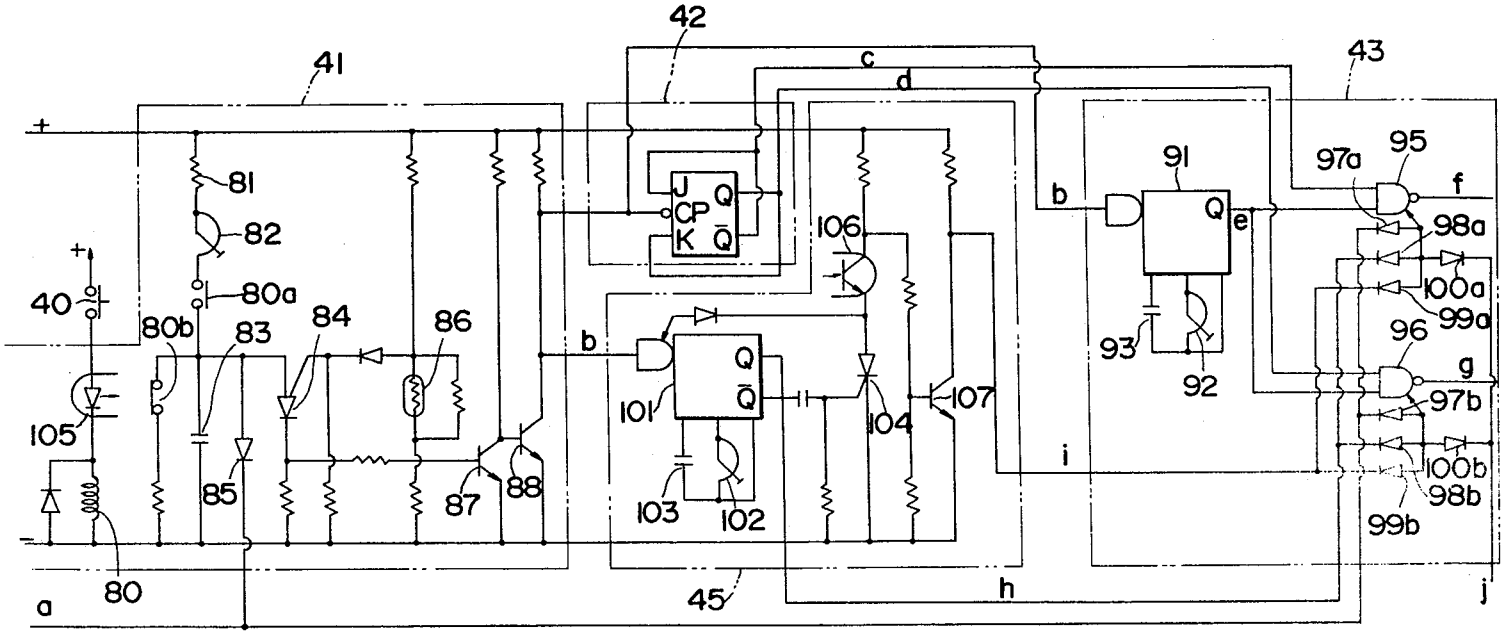
FIG. 9 is a circuit diagram showing an example of an inverter-action circuit of the power source circuit employed for X-ray emission shown in FIG. 3.

As shown in FIG. 9, the oscillator circuit 41 shown in FIG. 3 comprises: a relay 80 which is energized when the exposure switch 40 is closed; relay contacts 80*a* and 80*b*; a resistor 81, a variable resistor 82 and a capacitor 83 which jointly constitute an integration circuit; a programmable uni-junction transistor 84 which discharges capacitor 83 when the voltage on capacitor 83 reaches a predetermined level; a diode 85 which keeps the capacitor 83 from being charged even when the contact 80*a* is in its closed state if the output a of the timer circuit 39 is at a low level; a temperature compensating resistor 86; and amplifier transistors 87 and 88. This oscillator circuit 41 becomes operative when the output a of the timer circuit 39 becomes a high level after the lapse of 1.8 seconds following the closure of the contact 27*a*$_2$, to produce, at an output b, a pulse with a small duty factor at a frequency of 1000 Hz when the relay 80 is energized and its contact 80*a* is closed whereas the contact 80*b* is opened.

The frequency divider circuit 42 is a JK flip-flop which has the output b of the oscillator circuit 41applied to its clock pulse input. This frequency divider circuit produces rectangular wave pulses with a duty factor of 50% with the outputs c and d alternately becoming a high level (on) and a low level (off) (see FIG. 10).

Figure 10:
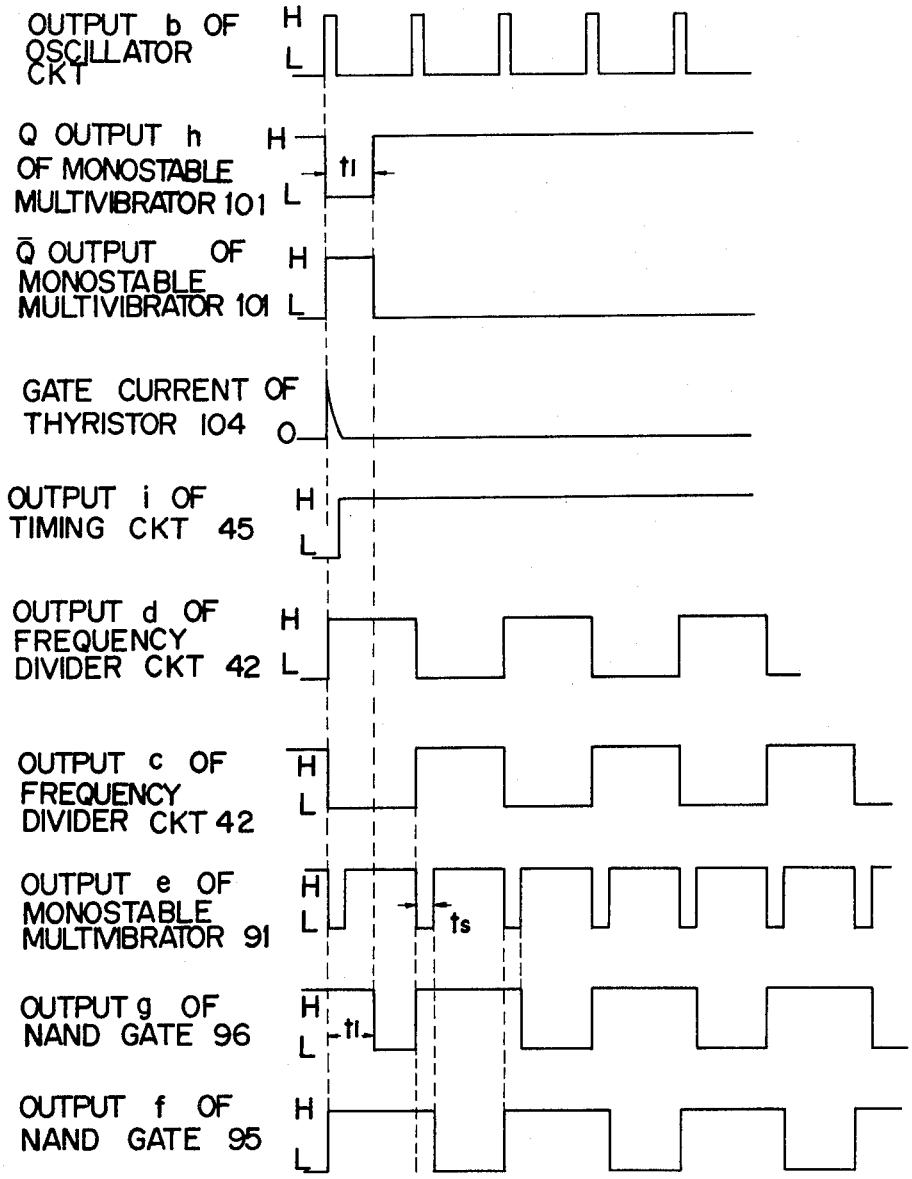
FIG. 10 is a time chart for explaining the operation of the circuitry of FIG. 9.

The drive signal forming circuit 43 comprises a monostable multivibrator 91 having a capacitor 93 and a variable resistor 92 for setting a time $t_s$ which renders output e to a low level for a time $t_s$ after the output b of the oscillator circuit 41 has become a high level (on) as shown in FIG. 10; a NAND gate 95 having, as its inputs this output e of the monostable multivibrator 91 and the output c of the frequency divider circuit 42; a NAND gate 96 having, as its inputs the output e of the monostable multivibrator 91 and the output d of the frequency divider circuit 42; diodes 97*a* and 97*b* to the cathode terminals of which are connected to the output a of the timer circuit 39 and the annode terminals of which are connected to NAND gates 95 and 96, respectively; diodes 98*a* and 98*b* the cathode terminals of which are connected to an output h of a monostable multivibrator 101 of the timing circuit 45 which will be described later and the annode terminals of which are connected to the NAND gates 95 and 96, respectively; diodes 99*a* and 99*b* the cathode terminals of which are connected to an output i of said timing circuit 45 and the annode terminals of which are connected to the NAND gates 95 and 96, respectively; and diodes 100*a* and 100*b* the cathode terminals of which is connected to an output j of the filament current detector circuit 46 and the annode terminals of which are connected said NAND gates 95 and 96, respectively.

The timing circuit 45 is a circuit employed to delay, for a length of time $t_1$ (see FIG. 10) which is longer than the aforesaid time $t_s$, the time at which the output g of a NAND gate 96 of the drive signal forming circuit 43 becomes a low level, when the output b of the oscillator circuit 41 is initially applied thereto. This timing circuit 45 comprises: a monostable multivibrator 101 having a capacitor 103 and a variable resistor 102 for setting the time $t_1$ for rendering the Q output (h) a low level and to rendering the Q output a high level, for a length of time $t_1$ after the output b of the oscillator circuit 41 becomes "on" (high level); a light-receiving transistor 106 which forms a photo-coupler with a light-emitting diode 105 provided in the oscillator circuit 41 which is rendered conductive when this diode 105 emits light; a thyristor 104 which is rendered conductive by the Q output of this monostable multivibrator 101 when light-receiving transistor 106 is conductive; and an output transistor 107 which is rendered non-conductive when thyristor 104 and light-receiving transistor 106 are rendered conductive.

Figure 11:
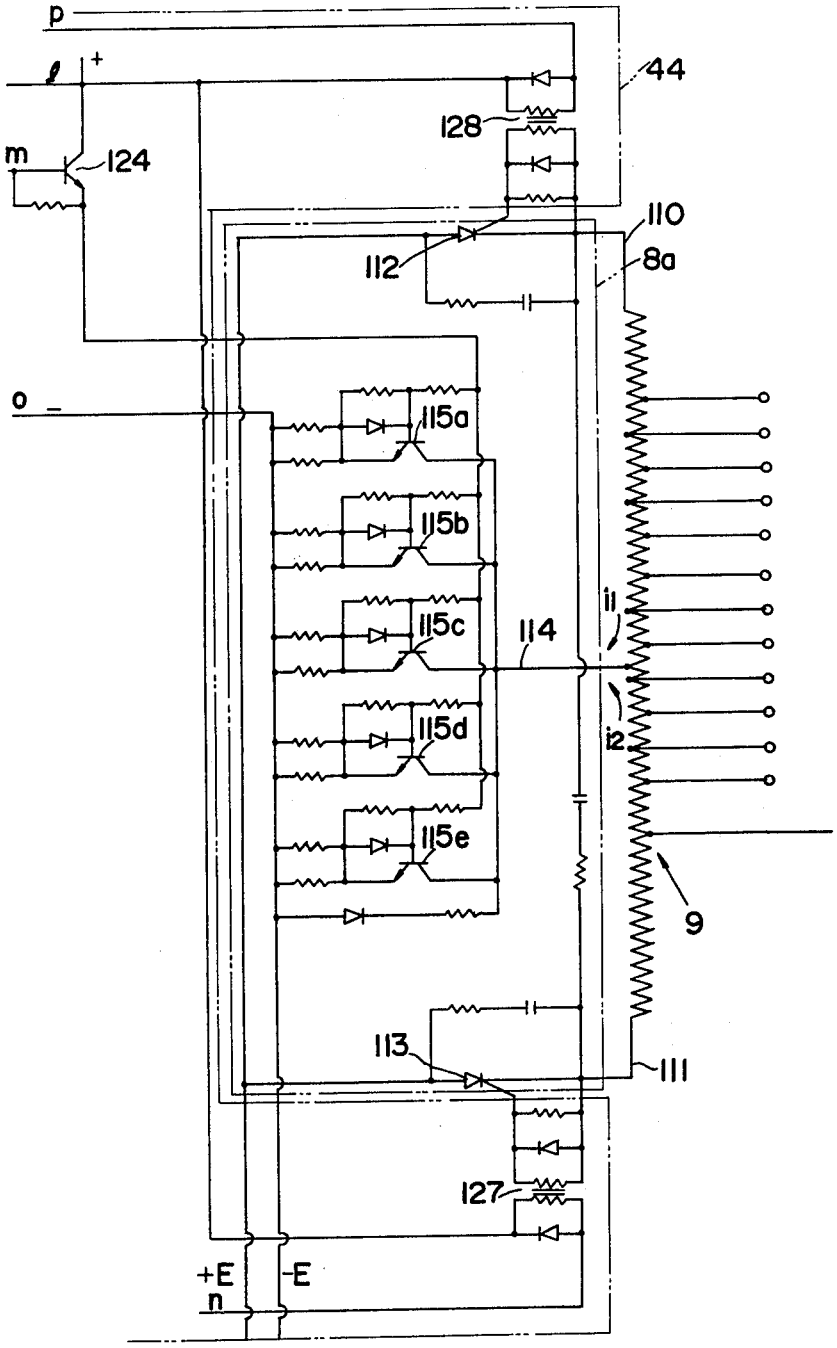
FIG. 11 is a circuit diagram showing an example of the inverter according to the present invention.

The inverter 8a shown in FIG. 11 is one embodiment of inverter 8 and has an arrangement comprising: wires 110 and 111 which are connected to the opposite terminals of a winding of the voltage regulating transformer 9; thyristors 112 and 113 connected to the wires 110 and 111, respectively; and five parallel connected transistors 115a to 115e connected to a wire 114 extending from the center top of the winding transformer 9.

The reason why five transistors are connected to the wire 114 is that readily available transistors 115a to 115e having a rated current of 50A are employed to carry the maximum current of 200A which flows through the transformer 9. If a transistor having a rated current greater than 200A is used, only one transistor may be used in place of the aforesaid transistors 115a to 115e.

Figure 12:
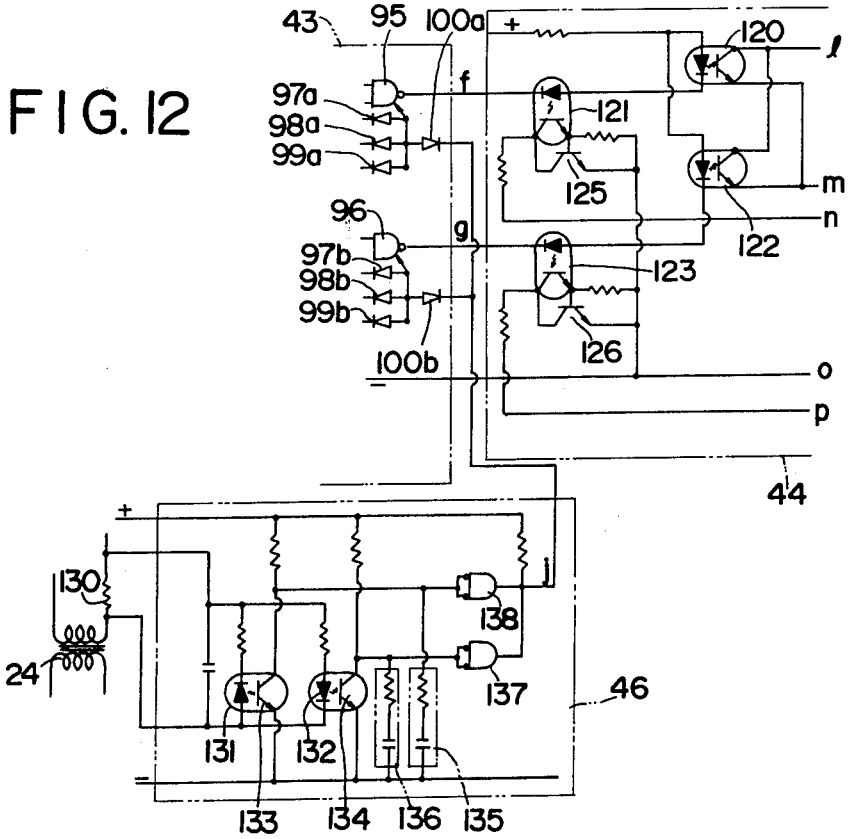
FIG. 12 is a circuit diagram showing an example of the inverter driving circuit and the filament current detection circuit, according to the present invention.

With respect to the inverter driving circuit 44 for driving this inverter 8a, one part thereof is shown in FIG. 11, and the other part in FIG. 12. The letters l, m, n, o, and p shown in FIGS. 11 and 12 indicate that these points are connected together in these two drawings which are separated because of the limitation on the size of the sheets of drawings. In FIGS. 11 and 12, reference numerals 120 and 121 represent photo-couplers which are rendered operative when the output of the aforesaid NAND gate 95 (illustrated in FIG. 9) becomes a low level, and reference numerals 122 and 123 represent photo-couplers which are rendered operative when the output of the aforesaid NAND gate 96 (also illustrated in FIG. 9) becomes a low level. The light-receiving transistors of the photo-couplers 120 and 122 are connected in parallel, so as to render the transistor 124 conductive when either one of them becomes conductive, so that the transistors 115a to 115e are rendered conductive accordingly. When the photo-coupler 121 becomes operational and the transistor 125 is rendered conductive accordingly, a current flows through pulse transformer 127, and because the transistors 115a to 115e are simultaneously rendered conductive, the thyristor 113 is rendered conductive. On the other hand, when the photo-coupler 123 is actuated thus rendering the transistor 126 conductive, a current flows through pulse transformer 128, and because the transistors 115a to 115e are simultaneously rendered operative, the thyristor 112 is rendered conductive. Accordingly, due to the fact that the output levels of the NAND gates 95 and 96 are alternately a low level as shown in FIG. 10, current $i_1$ and a current $i_2$ current $i_2$ alternately flow through the winding of the transformer 2 due to; the output voltages +E and −E of the main power source storage cell 6.

Next, a description will be made of the filament current detector circuit 46 by referring to FIG. 12. A resistor 130 having a small resistance value is connected in series with the primary winding of transformer 24 which is provided between filament heating inverter 22 and filament 23. The voltage across the terminals of this resistor caused by the current employed for heating the filament is applied to light-emitting diodes 131 and 132 which are connected in parallel in the opposite polarity relative to each other. Light-receiving transistors 133 and 134, which together with the respective light-emitting diodes 131 and 132 constitute photo-couplers are connected in parallel between the terminals of the power source. The collector voltages of these transistors 133 and 134 are smoothed by respective smoothing circuits 134 and 136, and the resulting smoothed voltages are applied to respective inverting gates 138 and 137. The outputs terminals of these inverting gates 138 and 137 are connected together, and therefore, if the output of one of these two inverting gates is a low level, the output j of this filament current detector circuit 46 will be a low level. It is only when the outputs of these two inverting gates 138 and 137 are both a high level that the output j becomes a high level.

Figure 13:
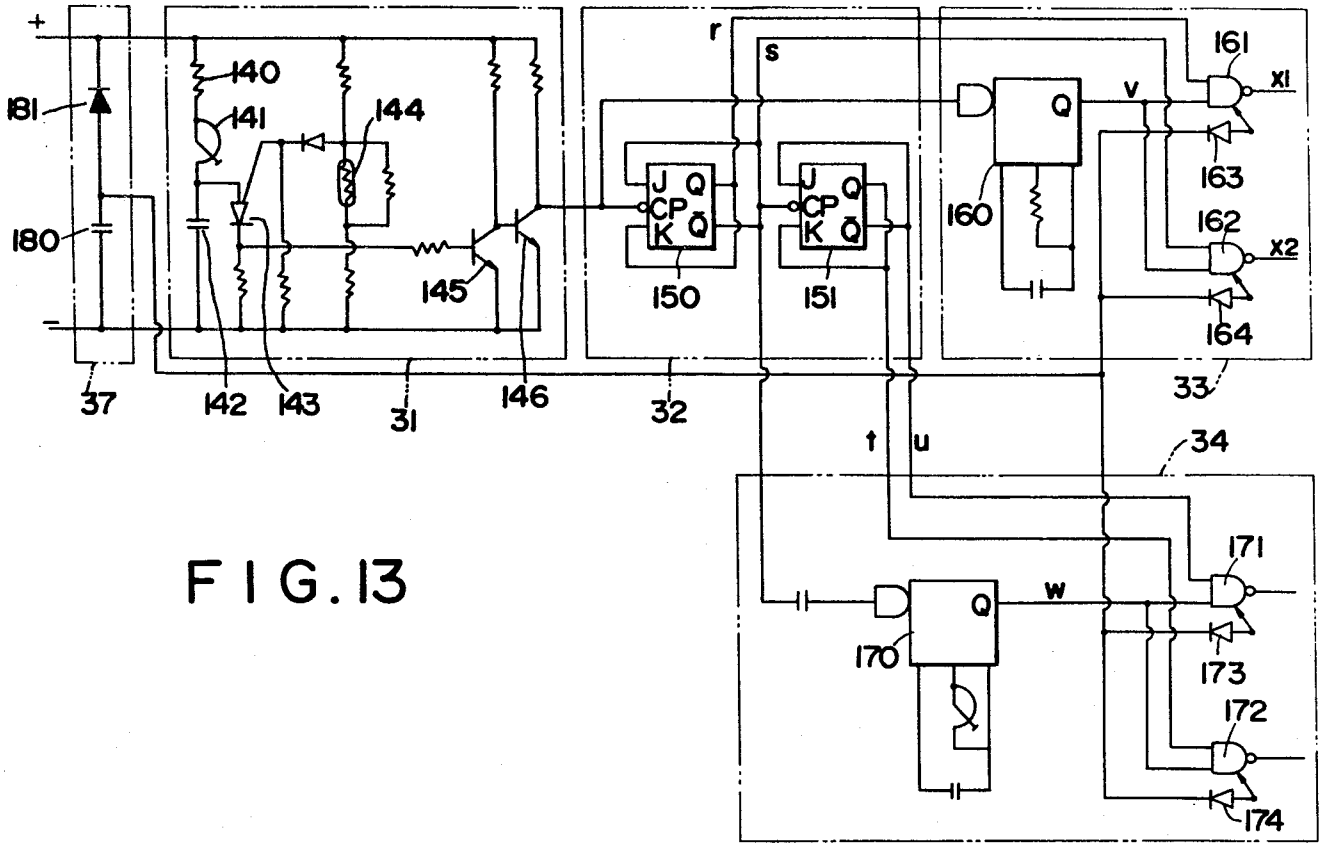
FIG. 13 is a circuit diagram showing an example the operating circuitry of an inverter used for heating the filament and of an inverter used for rotating the target, according to the present invention.

Description will now be made of a detailed example of the oscillator circuit 31, the frequency divider circuit 32, the gate signal forming circuits 33 and 35 and the timer circuit 37 shown in FIG. 3, by referring to FIG. 13. Firstly, the oscillator circuit 31 has an arrangement substantially similar to that of the oscillator circuit 41 shown in FIG. 9. This oscillator circuit is comprised of an integration circuit which, in turn, is formed of a resistor 140, a variable resistor 141 and a capacitor 142, a programmable uni-junction transistor 143, a temperature compensating resistor 144 and amplifier transistors 145 and 146. Oscillator circuit 41 generates a cyclic pulse having a small duty factor and a frequency of 240 Hz, as its output q.

The frequency divider circuit 32 is comprised of two JK flip-flops 150 and 151 which are connected in series. Signals r and s having a frequency which become "on" alternately and have a duty factor of 50% are derived from the JK flip-flop 150. Signals t and u having a frequency of 60 Hz which become "on" alternately and have a duty factor of 50% are derived from the JK flip-flop 151.

The circuit 33 for forming a gate signal for the inverter for heating the filament comprises of: a monostable multivibrator 160 for receiving the signals r and s and for preventing superposition of these signals thereby preventing short-circuiting of the inverter 22; NAND gates 161 and 162 receiving the respective outputs r and s of the JK flip-flop 150 as of one of the inputs thereof and receiving the output v from the monostable multivibrator 160 as another input thereof; and diodes 163 and 164 whose cathodes are connected in common to the timer circuit 37 and whose anodes are connected to the NAND gates 161 and 162, respectively.

The gate signal forming circuit 34 for forming gate signals for the inverter 20 for rotating the target has an arrangement similar to that of the circuit 33. This circuit 34 comprises: a monostable multivibrator 170 for preventing superposition of the signals t and u produced by the JK flip-flop 151 thereby preventing short-circuiting of the inverter 20; NAND gates 171 and 172 receiving the output w of monostable multivibrator 170 as one of the inputs thereof and receiving the respective signals u and t as the other inputs thereof; and diodes 173 and 174 whose cathodes are connected to the timer circuit 37 and whose anodes are connected to the NAND gates 171 and 172, respectively.

The timer circuit 37 comprises a capacitor 180 and a diode 181. This capacitor 180 is charged by the currents supplied thereto flowing from the NAND gates 161 and 162 and passing through the respective diodes 163 and 164 and also by the currents supplied thereto flowing from the NAND gates 171 and 172 and passing through the respective diodes 173 and 174. When the voltage of this capacitor exceeds 5V, the NAND gates 161, 162, 171 and 172 are rendered operative.

In this circuit, the time from after the closure of the contact $27a_2$ shown in FIG. 3 until the NAND gates 161, 162, 171 and 172 are rendered operative is set, by selecting the elements of the timer circuit 37, to be 0.05 second which is the length of the time from the starting of the oscillator circuit 31 until it is able to operate stably.

Figure 14:
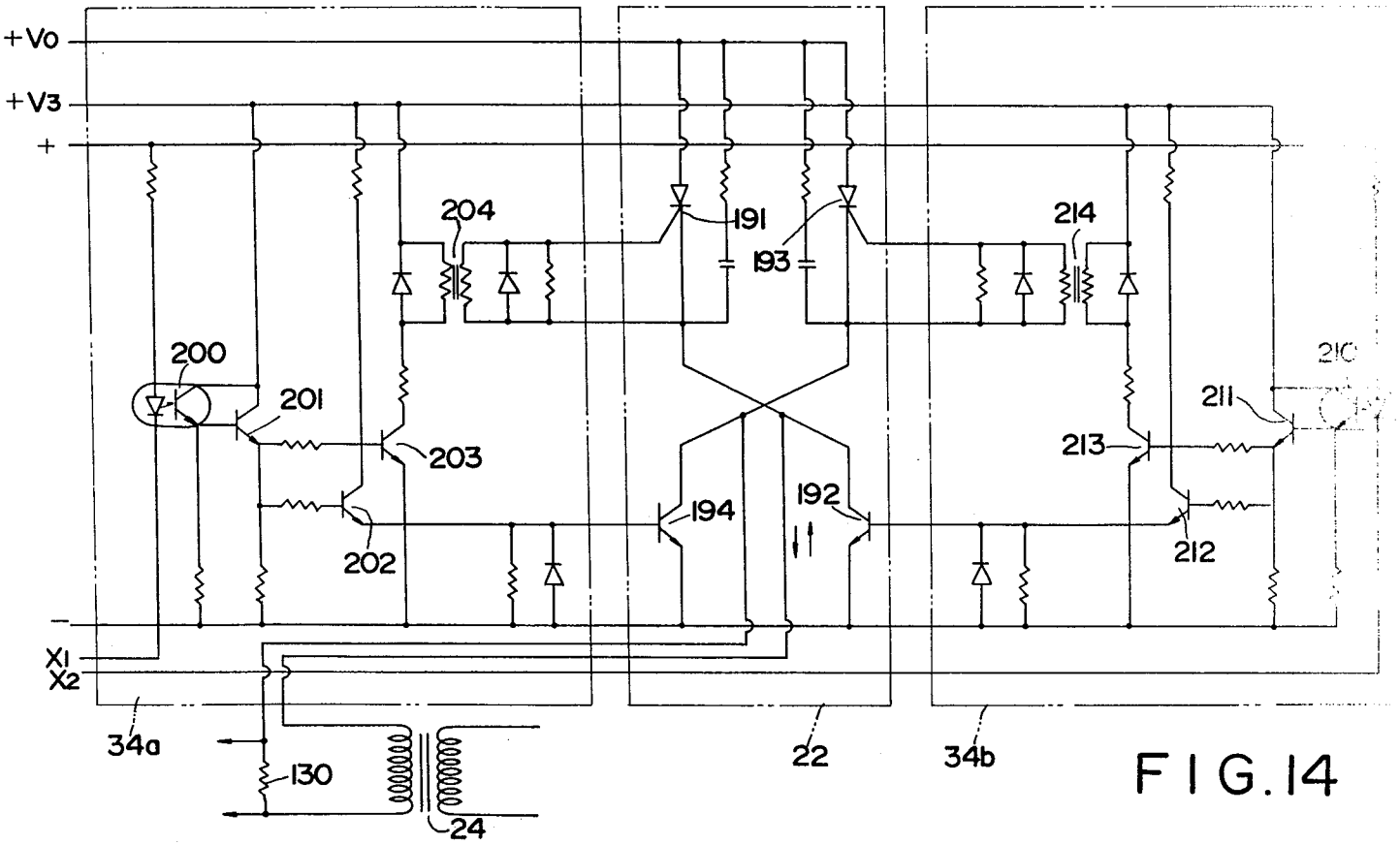
FIG. 14 is a circuit diagram showing an inverter for heating the filament and a circuit for driving this inverter, according to the present invention.

The filament heating inverter 22, as shown in FIG. 14, is a parallel connection of the series connection circuit of a thyristor 191 and a transistor 192 and the series connection circuit of a thyristor 193 and a transistor 194. The output voltage $V_0$ of the stabilizer circuit 21 shown in FIG. 2 is applied to this inverter 22. The inverter driving circuit 34 is illustrated as divided into a circuit 34*a* and a circuit 34*b*. The circuit 34*a* has: a photo-coupler 200 which is rendered operative when the output $x_1$ of NAND gate 161 becomes a low level; a transistor 201 which is rendered conductive by the action of photo-coupler 200; transistors 202 and 203 which are rendered conductive by the conduction of transistor 201; and a pulse transformer 204. This circuit 34*a* is arranged so that the transistors 202 and 203 are rendered conductive when the output $x_1$ of the NAND gate 161 becomes a low level, at the same time the transistor 194 is rendered conductive, and also the pulse transformer 204 is energized. Thus a gate current flows to the thyristor 191, and this thyristor is rendered conductive. On the other hand, the circuit 34*b* has a photo-coupler 210 which is rendered operative when an output $x_2$ of NAND gate 162 becomes a low level; a transistor 211 which is rendered conductive by the action of photo-coupler 210; transistors 212 and 213 which are rendered conductive by the conduction of transistor 211; and a pulse transformer 214. This circuit 34*b* is arranged so that the transistors 212 and 213 are rendered conductive when the output $x_2$ of the NAND gate 162 becomes a low level, at the same time, the transistor 192 is rendered conductive, and also the pulse transformer 214 is energized. Thus a gate current flows to the thyristor 191 so that the thyristor 191 is rendered conductive. Accordingly, owing to the fact that the outputs of the NAND gates 161 and 162 alternately become a low level, an ac current flows in to the transformer 24, so that the filament 23 is heated. It should be understood that $+V_3$ represents the voltage of the auxiliary storage cell which is directly applied from auxiliary storage cell 7.

The inverter driving circuit 36 and the inverter 20 which are operated by the output signals of the NAND gates 171 and 172 are also arranged in a similar way, therefore their illustration and description are omitted for the sake of brevity.

Figure 15:
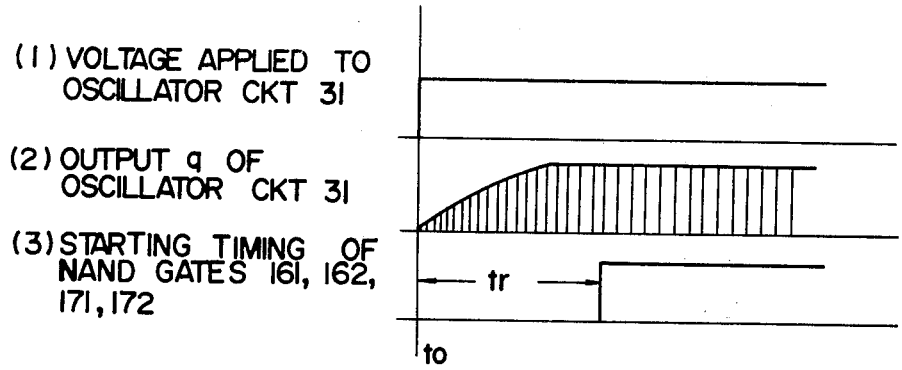
FIG. 15 is a time chart explaining the operation of a part of the circuitry of FIG. 13.

Next description will be made of the operations of the circuitries of the present invention shown in FIGS. 8, 9 and 11 to 14. As will be understood from the connection shown in FIG. 3, the voltage of the auxiliary storage cell (preferably a voltage which represents the stabilized voltage of this storage cell) is applied to the circuit shown in FIG. 13 by the closure of the relay contact 27*a*$_2$ which is actuated by the closing action of the ready switch. In this case, as shown in FIG. 15, the contact 27*a*$_2$ is closed at time $t_0$ and accordingly the voltage shown in FIG. 15(1) is applied to the oscillator circuit. The output of the oscillator circuit 31 is such that in its initial state, neither the height of the wave nor its frequency is in a constant state as shown in FIG. 15(2). If the inverters 20 and 22 where actuated in such a state, there could develop short-circuiting in these inverters 20 and 22. Therefore, in the initial state, the currents flowing through the NAND gates 161, 162, 171 and 172 are allowed to flow to the capacitor 180 of the timer circuit 37 through diodes 163, 164, 173 and 174 to charge this capacitor. After a time $t_r$ (0.05 second) set by timer circuit 37 the output of the oscillator circuit 31 becomes stabilized, and these NAND gates are rendered operative.

On the other hand, the circuit constant of the timer circuit 39 shown in FIG. 8 is such that 1.8 seconds after the closure of the contact 27*a*$_2$, the output a will become a high level. This represents the time required for the target 15 to rotate up to a substantially constant speed of about 3250 rpm and also the time required for the filament 23 to be heated to a substantially constant temperature.

As stated above, by arranging so that the high voltage is applied to the X-ray tube only after the target is able to rotate at a constant speed, whereby the target unfailingly rotates at a constant speed when X-rays impinge upon the target, the melting of the target can be prevented. Also, when the high voltage is applied to the X-ray tube, the filament is already heated to the required temperature, so that stable X-ray emission occurs, and also so that an excessively high voltage between the terminals of the X-ray tube can be prevented.

The output a of the timer circuit 39 is applied to the cathode of the diode 85 of the oscillator circuit 41 shown in FIG. 9 and also to the cathodes of the diodes 97*a* and 97*b* of the drive signal forming circuit 43. Thus, even when the exposure switch 40 is closed within 1.8 seconds after the closure of the contact 27*a*$_2$ and, accordingly, the relay 80 is energized, the contact 80*a* is closed and the contact 80*b* is opened, the current flowing on the resistor 81 and to the variable resistor 82 is allowed to flow to the negative terminal through the diode 85. Therefore the capacitor 83 is not charged. Accordingly, the oscillator circuit 41 will not oscillate within 1.8 seconds after the closure of the contact 27*a*$_2$. Also, there is the fear that the inputs c to the NAND gate 95 and d to the NAND gate and 96 will become a high level at the moment that the power source voltage is applied to the circuitry shown in FIG. 9 by the closing action of the contact 27*a*$_2$. However, so long as the output a of the timer circuit 39 remains a low level, the currents applied to the NAND gates 95 and 96 are allowed to flow via the diodes 97*a* and 97*b*, so that the outputs f of the NAND gate 95 and g of the NAND gate and 96 remain at a high level. Accordingly, the inverter 8*a* will never be actuated under these conditions.

Upon the lapse of 1.8 seconds after the time of closure of the contact 27*a*$_2$, the timer circuit 41 will immediately start oscillation when the exposure switch 40 is closed. Also, when the exposure switch 40 is closed after the lapse of 1.8 seconds, the timer circuit 41 will start its oscillating action at that closing time. By the fact that, after this oscillating action is started, the Q output h of the monostable multivibrator 101 becomes a low level for the time $t_1$ ($t_1 > t_s$) from the time that the first pulse b is produced, the output g of the NAND gate 96 will become a low level at a time which is delayed by $t_1$ from the low level to high level transistion of the output b of the oscillator circuit 41 as shown in FIG. 10. Thus, this output will be a low level for a period of time shorter than that of the succeeding pulses.

Figure 16:
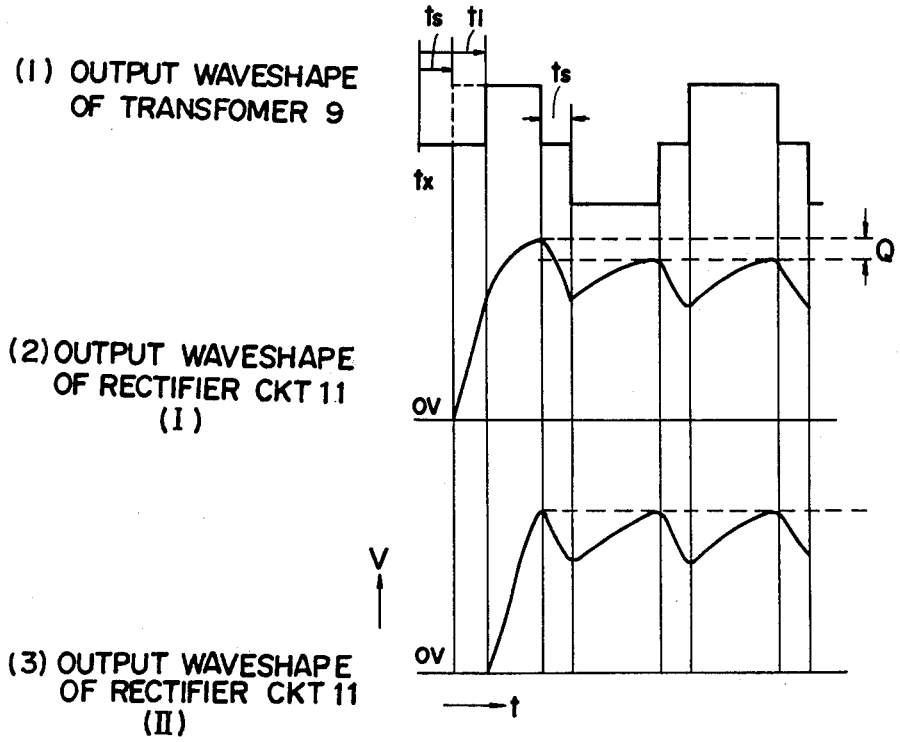
FIG. 16 is a time chart explaining the action of the timer circuit in the present invention.

Making only the initial pulse shorter as stated above brings about the following advantages. FIG. 16(1) shows the waveshape of the output during the initial period of operation (the dotted line indicates the instance where there is no delay in the drive signal of the inverter as in the prior art, whereas the solid line represents the instance wherein there is a delay of $t_1$ from the low to high transistion time $t_x$ of the initial output b of the oscillator circuit according to the present invention). FIG. 16(2) shows the output waveshape of the rectifier circuit 11 when the delay time is $t_s$. FIG. 16(3) shows the output waveshape of the rectifier circuit 11 when the delay time is $t_1$ as in the present invention. As will be understood from FIG. 16, the conventional system, generates an overshoot Q. However, when the conduction of the inverter is delayed for the initial half cycle as in the present invention, it is possible to eliminate this overshoot Q. The elimination of this overshoot Q is achieved by delaying the built-up of voltage in the resistances of the wires and cables of the transformers 9 and 10 and also by the action of the stray capacitances which are present in these wires and cables. Upon the arrival of the second of the subsequent pulses, the high voltage of the rectifier circuit 11 has not dropped completely to zero due to the action of the aforesaid stray capacitances, and accordingly an abnormally high voltage is not generated in the output of this rectifier circuit. Accordingly, it is possible to obviate the risk of dielectric breakdown of the X-ray tube or the like due to an abnormally high voltage at the time of application of the initial voltage to the X-ray tube, and thus the life of the X-ray tube and so forth can be elongated.

It should be understood that the time constant of the monostable multivibrator 101 can be varied by the variable resistor 102 so that it is possible to obtain a time constant which matches the type of the apparatus employed. Accordingly, as shown in FIG. 16(3), it is possible to make the maximum wave height of the voltages in the respective cycles uniform.

The transistor 107 maintains the cathodes of the diodes **99*a* and 99*b* at a high level only when the thyristor 104 is rendered conductive, the exposure switch 40 is closed and the light-receiving transistor 106 is rendered conductive. In order cases transistor 107 keeps these cathodes at a low lvel, so as to prevent erroneous gate pulses from being generated by the NAND gates 95 and 96**, Whereby safety operation is assured.

The inverter **8*a* shown in FIG. 11 comprises thyristors 112 and 113, and transistors 115*a* to 115*e* which operate simultaneously. Thus, as compared with the instance wherein these transistors are replaced by thyristors, it is possible to prevent the development of an extreme drop in the dc power source voltage at the time of loading, or a variation of the load current, or a failure to change the current flow line due to external reasons, and thus it is possible to achieve a stabilized action of the inverter. Also, the time $t_s$ which is set by the monostable multivibrator 91 is sufficient to permit the inverter to operate only if there is time enough for rendering the thyristors 112 and 113** non-conductive. Furthermore, by appropriately changing this time $t_s$, it is possible to simultaneously carry out the regulation of the power which is supplied to the load. Also, an inverter which is a combination of transistors and thyristors has the advantage, as compared with an inverter comprised of only thyristors, that a commutating changing capacitor and a commutating reactor are not required, and that accordingly the inverter can be made lighter in weight.

Also, it is possible to use an inverter having the arrangement shown in FIG. 14, i.e. a parallel connection of two sets of circuits each being a series connection of thyristors in place of the inverter **8*a* shown in FIG. 11 and transistors. However, the arrangement shown in FIG. 11** has the advantage that the number of required elements is small.

Also, the present invention, employs a storage cell which is the source for supplying power to the X-ray tube, and a separate storage cell which serves as a power source for the control circuitry. Therefore, the control circuitry is not subjected to the effect of the substantial variation of voltage of the storage cell for the X-ray tube that occurs during the emission of X-rays, and thus this control circuit is able to perform a stabilized controlling action. Furthermore, when a stabilizer circuit for stabilizing the output voltage of the auxiliary storage cell is desired, it is possible to achieve a simplified arrangement of this stabilizing circuit at a low cost.

The filament current detector circuit 46 shown in FIG. 12 operates so that, in case the flow of current to the filament 23 is a uni-direction, or in case no current at all flows to this filament, this circuit 46 serves to pull-in the currents which are applied to the NAND gates 95 and 96 via the diodes **100*a* and 100*b*, thereby rendering these NAND gates 95 and 96 inoperative. Therefore, when the filament 23 is heated only by a uni-directional current or is not heated at all, the inverter 8*a* is not driven, and accordingly no a high voltage is applied to the X-ray tube 2. With such an arrangement as described above, it will be understood that, in case of incomplete heating of the filament, it is possible to prevent an abnormal rise of the voltage across the terminals of the X-ray tube 2 which would develop when a dc high voltage is applied while the filament generates only a little heat or no heat, and thus the occurrence of dielectric breakdown of the X-ray tube 2** can be prevented.

Figure 17:
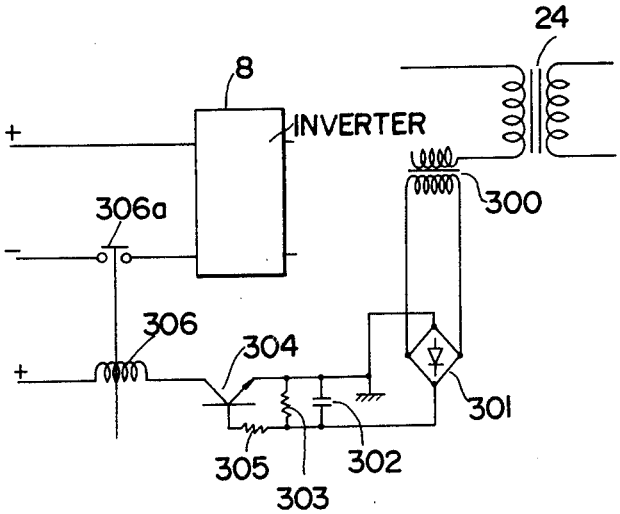
FIG. 17 is a circuit diagram showing another example of the filament current detection circuit.

In place of the filament current detector circuit 46 shown in FIG. 12, it is possible to use a circuit as shown in FIG. 17. In the circuit shown in FIG. 17 ac detector 300 is connected in series with the primary winding of the transformer 24 connected to the filament. The output of ac detector 300 is rectified by a rectifier 301, and that the output of this rectifier 301 is smoothed by a capacitor 302 and a resistor 303. The voltage across this capacitor 302 is applied between the base and the emitter of transistor 304 via a resistor 305. The relay 306 is connected in series with this transistor 304, and a normally open contact **306*a* of the relay 306 is connected to the power source line of the inverter 8. When, so that when the current flowing through the transformer 24, i.e. the filament current, is below a predetermined level, or when it is a half wave current the transistor 304 is not rendered conductive, by proper selection of the constituting elements of this circuitry. Therefore, it is possible to render the inverter 8** inoperative at the time of incomplete heating or non-heating of the filament, thereby preventing of dielectric breakdown of the X-ray tube.

What is claimed is:

1. A storage cell type X-ray apparatus comprising:

a storage cell for producing a dc voltage;

an inverter connected to said storage cell for converting said dc voltage into an voltage;

a voltage regulating transformer connected to said inverter, having said ac voltage applied to one of a plurality of taps of the primary winding thereof, for generating an ac voltage regulated in amplitude;

a voltage step-up transformer connected to said voltage regulating transformer for stepping up said regulated ac voltage to a high ac voltage;

a rectifier connected to said voltage step-up transformer for rectifying said high ac voltage into a high dc voltage;

an X-ray tube to which said rectifier is connected for applying said high dc voltage between the anode and the cathode thereof, for emission of X-rays; and a compensator circuit connected to said storage cell and said voltage regulating transformer for preventing a drop in said high dc voltage applied to said X-ray tube due to a drop in said dc voltage of said storage cell having a storage cell voltage detector circuit connected to said storage cell for detecting the magnitude of said dc voltage, a reference voltage generating circuit for generating a predetermined reference voltage, a comparator connected to said storage cell voltage detector circuit and said reference voltage generating circuit for generating an output when said magnitude of said dc voltage is less than said reference voltage, and a self holding relay connected to said comparator and said voltage regulating transformer actuated by said output of said comparator having contacts for continued self actuation and for changing the tap of said primary winding of said voltage regulating transformer having said dc voltage applied thereto for increasing said regulated ac voltage.

2. A storage cell type X-ray apparatus according to claim 1, further comprising: means for preventing application of said output of said comparator to said self holding relay during the X-ray emission of said X-ray tube.

3. A storage cell type X-ray apparatus according to claim 1, wherein said voltage regulating transformer has a center tapped primary winding and said inverter comprises:

a first thyristor connecting a first terminal of said storage cell with a first terminal of said center tapped primary winding of said voltage regulating transformer;

a second thyristor connecting said first terminal of said storage cell with a second terminal of said center tapped primary winding of said voltage regulating transformer; and at least one transistor connecting the second terminal of said storage cell with the center tap of said center tapped primary winding of said voltage regulating transformer.

4. A storage cell type X-ray apparatus as claimed in claim 1 wherein:

said X-ray tube further comprises a filament for heating said X-ray tube and a rotating target; and said apparatus further comprises:

a filament current inverter connected to said storage cell and said filament of said X-ray tube for converting said dc voltage to a filament ac voltage and applying said filament ac voltage to said filament;

a target rotation inverter connected to said storage cell and said X-ray tube for converting said dc voltage into a rotation ac voltage and applying said rotation ac voltage to said X-ray tube for rotation of said rotating target;

an auxiliary storage cell for producing an auxiliary dc voltage; and a control circuit connected to said filament current inverter, said target rotation inverter and said auxiliary storage cell, powered by said auxiliary dc voltage for controlling the converting function of said inverters.

5. A storage cell-type X-ray apparatus as claimed in claim 1 wherein:

said X-ray tube further comprises a filament for conducting a filament current therethrough for heating said X-ray tube: said apparatus further comprising:

a filament current detector circuit connected to said filament and said inverter for detecting the magnitude of said filament current and preventing the application of said high dc voltage of said X-ray tube when said filament current is less than a predetermined magnitude.

6. A storage cell type X-ray apparatus according to claim 1, further comprising: an inhibiting circuit connected to said storage cell for preventing the application of said high dc voltage to said X-ray tube when the voltage of said storage cell falls below an unusable minimum voltage.

7. A storage cell type X-ray apparatus according to claim 6, wherein said inhibiting circuit comprises:

a lower limit voltage setting circuit for setting said unusable minimum voltage;

a lower limit comparator connected to said lower limit voltage setting circuit and said storage cell voltage detector circuit for generating a lower limit output when said magnitude of said dc voltage is less than said unusable minimum voltage; and a relay actuated by said lower limit output for preventing the application of said high dc voltage to said X-ray tube.

8. A storage cell type X-ray apparatus as claimed in claim 1 further comprising:

an inverter driving circuit connected to said inverter circuit for generating inverter driving pulses for control of said converting function of said inverter; and a timing circuit connected to said inverter driving circuit for delaying the application of said inverter driving pulses to said inverter for a predetermined length of time when said apparatus is initially actuated.

9. A storage cell type X-ray apparatus according to claim 8, wherein:

said X-ray tube further comprises a filament for heating said X-ray tube and a rotating target; and said apparatus further comprises:

a filament current inverter connected to said storage cell and said filament of said X-ray tube for converting said dc voltage into a filament ac voltage and applying said filament ac voltage to said filament;

a target rotation inverter connected to said storage cell and said X-ray for converting said dc voltage into a rotation ac voltage and applying said rotation ac voltage to said X-ray tube for rotation of said rotating target; and said predetermined length of time of said timing circuit is sufficient for said filament to heat said X-ray tube to a predetermined constant temperature and for said rotating target to rotate at a predetermined constant speed.

10. A storage cell type X-ray apparatus according to claim 9, wherein said inverter driving circuit comprises:

an oscillator circuit actuated at the end of said predetermined length of time of said timing circuit for generating an oscillator signal at a predetermined frequency;

a frequency divider circuit connected to said oscillator circuit for producing rectangular wave pulses having a duty cycle of 50% and a frequency an integral fraction of said predetermined frequency of said oscillator circuit; and a driving pulse forming circuit connected to said frequency divider circuit for generating said inverter driving pulses from said rectangular wave pulses.

11. A storage cell type X-ray apparatus according to claim 9, further comprising:

an oscillator circuit for generating an oscillator signal at a predetermined frequency;

a frequency divider circuit connected to said oscillator circuit for producing rectangular wave pulses having a duty cycle of 50% and a frequency an integral fraction of said predetermined frequency of said oscillator circuit; and a driving pulse forming circuit connected to said frequency divider, said filament inverter and said target rotation inverter for generating filament inverter driving pulses for application to said filament inverter and target rotation inverter driving pulses for application to said target rotation inverter, whereby said timing circuit delays application of said inverter driving pulses to said inverter for said predetermined period of time after actuation of said oscillator circuit.

* * * * *